US006599005B2

(12) United States Patent
Van Der Wel

(10) Patent No.: US 6,599,005 B2
(45) Date of Patent: Jul. 29, 2003

(54) INTENSIVE MIXER

(75) Inventor: Peter Gerardus Van Der Wel, Doetinchem (NL)

(73) Assignee: Hosokawa Micron BV (NL)

( * ) Notice: Subject to any disclaimer, the term of this patent is extended or adjusted under 35 U.S.C. 154(b) by 0 days.

(21) Appl. No.: 09/867,316

(22) Filed: May 29, 2001

(65) Prior Publication Data

US 2001/0024400 A1 Sep. 27, 2001

Related U.S. Application Data

(63) Continuation-in-part of application No. 09/095,679, filed on Jun. 10, 1998, now abandoned.

(30) Foreign Application Priority Data

Jun. 13, 1997 (NL) ..... 1006311

(51) Int. Cl.[7] ..... B01F 7/20; B01F 15/02; B01F 15/06

(52) U.S. Cl. ..... 366/143; 366/149; 366/168; 366/192; 366/309; 366/326.1

(58) Field of Search ..... 366/143, 149, 366/168.1, 192, 309, 326.1

(56) References Cited

U.S. PATENT DOCUMENTS

| | | | | |
|---|---|---|---|---|
| 4,577,973 A | 3/1986 | Occelli | ..... | 366/139 |
| 4,721,390 A | 1/1988 | Lidgren | ..... | 366/139 |
| 5,344,232 A | 9/1994 | Nelson et al. | ..... | 366/139 |
| 5,505,538 A | 4/1996 | Earle | ..... | 366/139 |

FOREIGN PATENT DOCUMENTS

| | | | | |
|---|---|---|---|---|
| EP | 0306563 | 9/1987 | ..... | F26B/3/34 |

*Primary Examiner*—Robert J. Popovics
(74) *Attorney, Agent, or Firm*—Hayes Soloway P.C.

(57) ABSTRACT

A device for mixing of particulate material comprises a conical mixing vessel having a vertical axis, which vessel narrows in a downward direction and in which vessel at least one vertical mixing shaft is rotatable. A number of radial elements project from the mixing shaft, and carry paddles at their distal ends, adjacent the sidewall of the vessel. The radial elements are long and thin, while the mixing paddles are relatively short and are symmetrical round the axis of the elements. Due to the rotating paddles and the conical shape of the vessel, the contents move spirally upwardly. The layers of material closest the wall end to have less spiral and more upwards movement, so that the intermediate layer is subjected to strong shearing forces that promotes mixing.

47 Claims, 5 Drawing Sheets

INTENSIVE MIXER

This application is a continuation-in-part of my co-pending application Ser. No. 09/095,679 filed Jun. 10, 1998, now abandoned.

BACKGROUND OF THE INVENTION

The invention relates to a device for mixing, cooling, heating, drying and/or granulating of powder and/or granular materials, comprising a conical mixing vessel having a vertical axis, which narrows in a downward direction and in which at least one vertical mixing shaft can rotate, from which mixing shaft a number of elements project, of which the outer ends extend until close to the sidewall of the vessel.

DESCRIPTION OF THE PRIOR ART

From U.S. Pat. No. 5,344,232 a medical mixer of very small dimensions is known for preparing under partial vacuum small quantities of bone cement for orthopedic purposes in or near the operating room. This cement is used during medical bone operations, in which a prosthesis is fastened to a bone, such as for instance a hip. The shelf life of this bone cement is very limited, so that it is prepared shortly before use.

The mixer comprises a hand driven vertical mixing shaft, which extends through a flat upper lid and carries two opposite mixing paddles with different height. At a low number of revolutions, of for instance 30 to 40 revolutions per minute, a liquid monomer is mixed with a solid polymer powder under partial vacuum to a paste, which is pressed into a cartridge that is connected to a lower lid of the mixer and is thus ready for use.

BRIEF DESCRIPTION OF THE INVENTION

The object of the invention is the further development of this mixing device to an intensive mixer for industrial use, with which powdery, granular and/or pasty materials can be mixed, cooled, heated, dried and/or granulated.

According to the invention this object is reached in that the mixing shaft carries a great number of elements, and has a high to very high number of revolutions, by which the material to be treated experiences a very strong shearing on both the elements and the inner wall, the one and the other such, that in a very short time, a very intensive mixing of the product is effected.

According to a main embodiment of the invention the number of revolutions of the mixing shaft comprises 100 to 1000 revolutions per minute.

In a first preferential embodiment of the invention, in which the elements each carry one or more mixing paddles at the other end, that extend with another end parallel to and near to the inner sidewall of the vessel, the elements are rod shaped and have a large radial dimension, whereas the paddles are plate shaped and have a small radial dimension and are limited rotatable over an angle around the longitudinal axis of the rod shaped element.

In a second preferential embodiment of the invention the elements comprise knives, of which at least a part has a variable angle position with the vertical. Other characteristics and advantages of the invention will be apparent from the description below of a number of embodiments, referring to the accompanying drawings wherein like numerals depict like parts, and wherein:

DETAILED DESCRIPTION OF THE INVENTION

Figures 1, 1A:
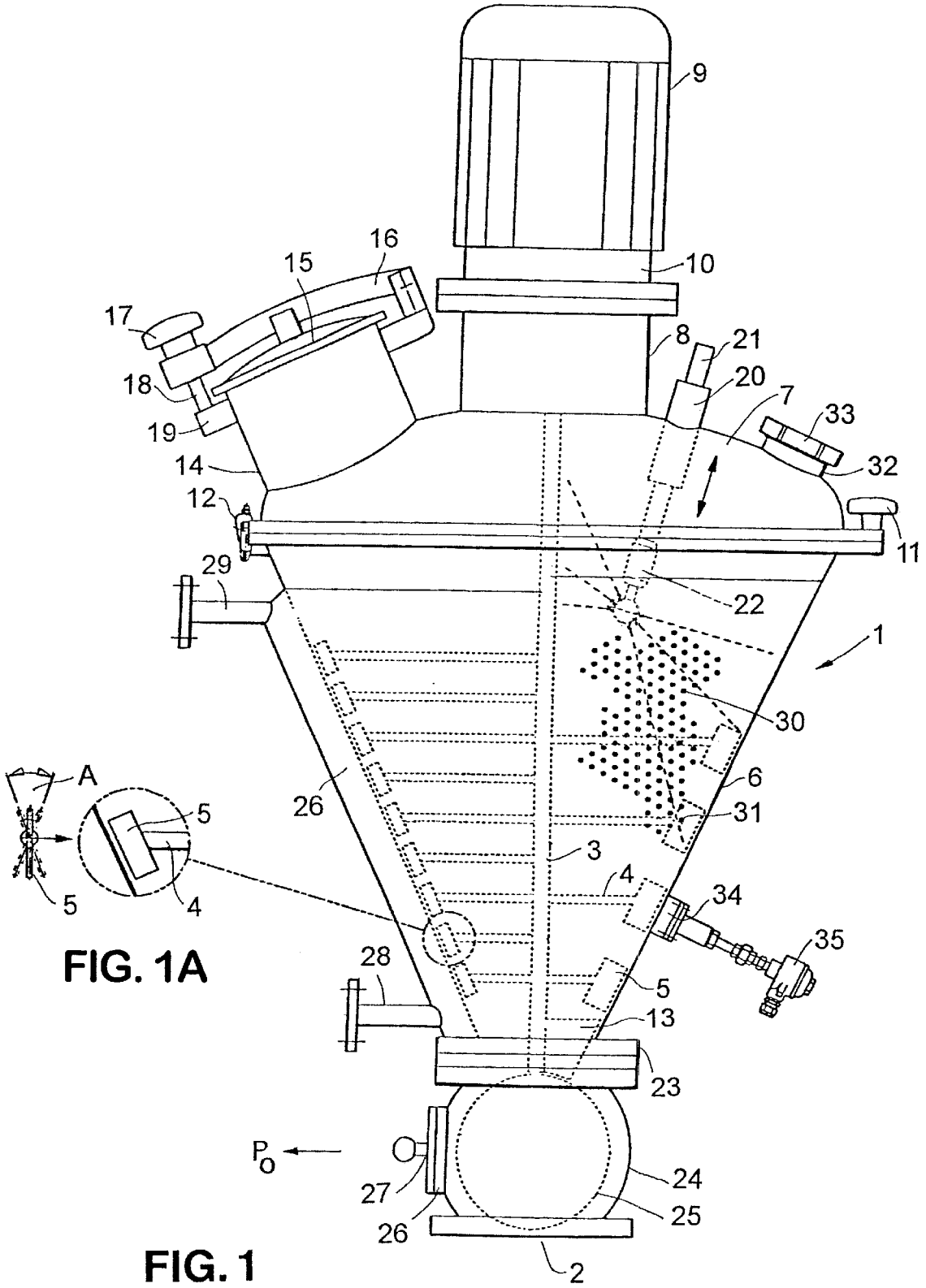
FIG. 1 shows in partial left side view and partial right cross section a mounted mixing device according to a first embodiment with rod shaped elements that carry paddles at the outer end.
FIG. 1A shows on an enlarged scale in side and front view details of FIG. 1 of the fastening of the paddles to the rods.

According to FIG. 1, the mixer is provided with a conical mixing vessel, that is generally indicated with 1, having a vertical axis 2, said vessel narrowing in a downward direction and in which at least one vertical mixing shaft 3 can rotate. From this mixing shaft 3 a number of elements 4 project gradually outwards, of which the outer end 5 extends until near the inner sidewall 6 of the vessel 1.

Figure 3:
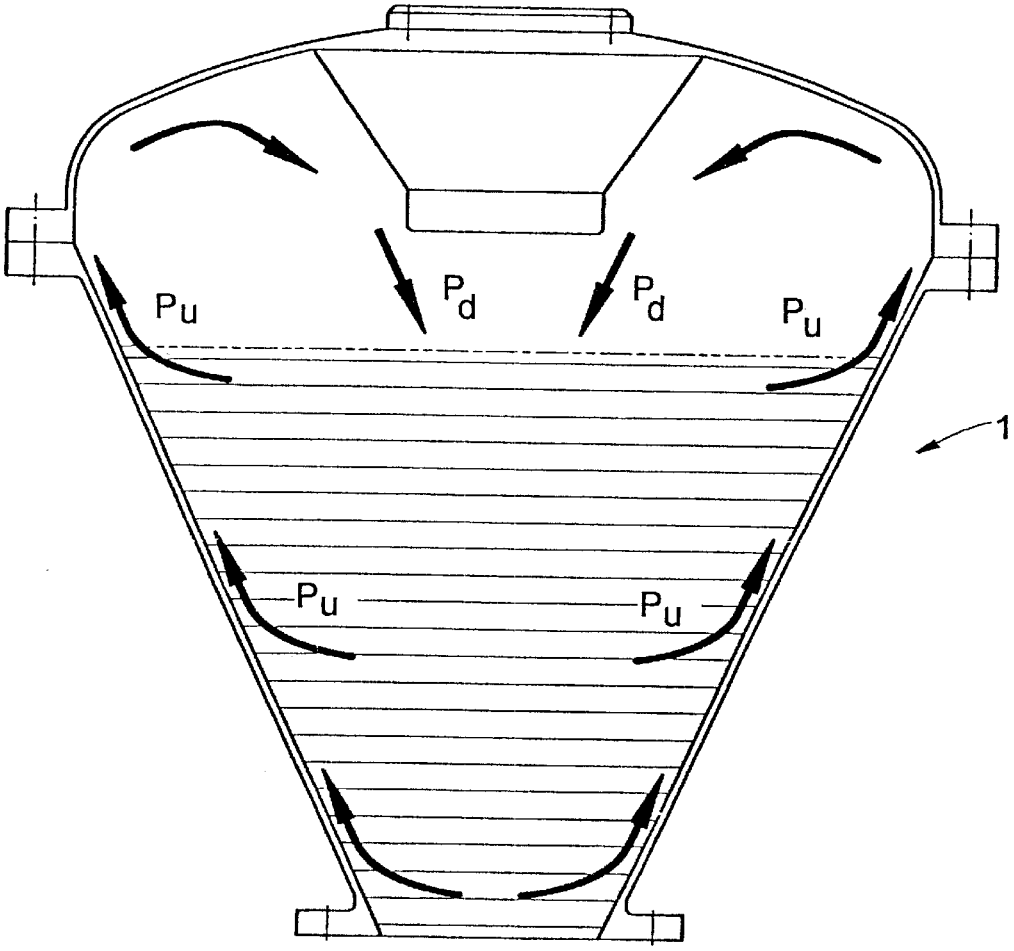
FIG. 3 shows a diagram of the flow of the product in the intensive mixer according to the invention.

The vessel 1 is closed at the upper side with a lid 7, of which the inner side is of substantially ellipsoid shape, on the one hand for strength and on the other hand for inward guiding of the product part Pu that possibly moves upwardly along the inner sidewall 6 into the lid 7 and in the direction of the center of the lid, from which it again drops back as Pd downwardly in the mixing vessel 1. FIG. 3 shows this flow diagram.

On top of the lid 7 in the axis 2 of the central mixing shaft 3 a drive motor 9 is fastened with the use of (not shown) seals and bearings on the central lid tube stub. Of this drive motor 9 the (not shown) outgoing driveshaft 10 is coupled with the mixing shaft 3. The mixing vessel 1 with the hoistable lid 7 can be closed vacuum tight by means of different types of quick fasteners, such as the screw bolt having a starhead 11 and a clamping screw 12, so that during operation vacuum can be applied to the mixing vessel 1. After the loosening of the quick acting fasteners it is possible to hoist the lid 2 together with its accessories by means of hoist means, such as arm 41, double acting plunger 42, cylinder 43 and second arm 44 in FIG. 2. In this way the mixing elements 4 can be cleaned, exchanged or repaired. It is also possible to inspect the vessel 1 internally or the lid 7 can be removed and quickly exchanged with another lid with accessories. At the lower end of the mixing screw 3 a scraper blade 13 is fastened in order to avoid a dead space in the bottom of the mixing vessel 1.

An eccentric tube stub 14 is also mounted on the lid 7, which stub can be opened and closed by means of an inspection lid 15. This is done with a pivotable arm 16, which can be screwed with a starhead 17 on a screwbolt 18 in the closing position in a uppertaining sidelog 19 of the stub 14. On the lid 7 there is also a passage 20 for a cleaning sprayer device 21 that can be extended and retracted, which spraying device carries a spray head 22 inside the vessel 1. At the lower side of the mixing vessel 1 a flange 23 is fastened, on which is mounted a ball segment valve 24, which contains a ball segment 25.

At the left half of FIG. 1 is shown, that the mixing vessel 1 is provided with an outer jacket 26 for heating and for cooling of the contents of a product P of the vessel 1. This jacket 26 carries connecting tube stumps 28 and 29.

It is also possible, such as shown in the right half of FIG. 1, that the sidewall 6 is made of a so-called "template," which is a double walled plate 13 that has been connected by welding in different places and is afterwards expended. Through the created hollow space a cooling or heating medium can be circulated. The lid 7 comprises a tube stub 32 for a looking glass 33.

According to the invention the mixing shaft 3 carries a great number of elements 4 and has a high to very high number of revolutions N. In this way the product to be treated experiences a very strong shearing at both the elements 4 as the inner sidewall 6, so that in a very short time a very intensive mixing of the product P is effected. By this mixing action a temperature rise can occur, which is counteracted by cooling the sidewall 6 of the mixing vessel 1.

Preferably, the drive motor is adapted to rotatably drive the mixing shaft to rotate at 100 to 1000 revolutions (N) per minute.

At a first preferential embodiment of the invention the elements 4 each carry at the outer end one or more mixing paddles 5, of which an outer edge extends parallel to and near the inner sidewall 6 of the vessel 1. Furthermore, the elements 4 are rod shaped and have a large radial dimension. Furthermore, the paddles 5 are plate shaped and have a small radial dimension. According to FIG. 1A at the left side of FIG. 1 the paddles 5 are limited pivotable over an angle (A) round the longitudinal axis of the rod shaped element. The paddles 5 are adjustable to match the angle of the vessel wall, and are fixed in this adjusted position.

Figures 2, 2A:
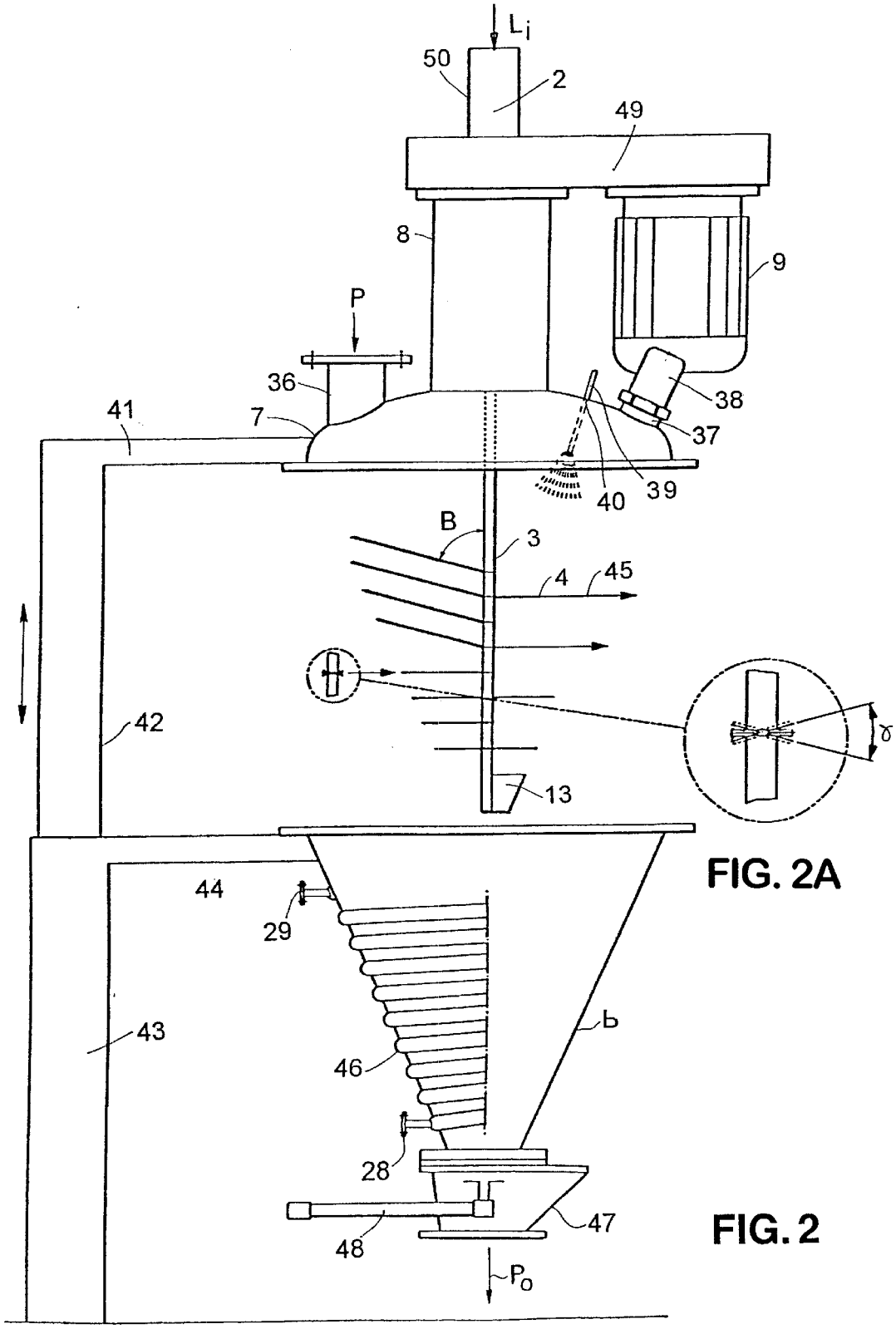
FIG. 2 shows in partial left side view without outer wall and partial right side view a mixing device according to a second embodiment, of which the lid has been removed and has been hoisted upwardly over at least the length of the mixing shaft, so that the mixing shaft, the mixing elements and the bottom scraper have become free from the mixing vessel and are visible.
FIG. 2A shows on an enlarged scale in side view a detail of FIG. 2 of the pivotable connection of the knives to the mixing shaft.

In FIG. 2 a second preferential embodiment of the invention is shown in the hoisted position of the lid 7 with accessories. The lid 7 is suspended on an upwardly and downwardly moveable horizontal arm 41 on the head of a hydraulic plunger 42 of a hoisting cylinder 43 which carries a fixed horizontal arm 44 at the upper side, on which the mixing vessel 1 is suspended. Also other than hydraulic hoisting tools can be employed.

Here the elements 4 according to the invention comprise knives, of which the angle B with the vertical of at least a part of the knives is variable.

At a variant drawn at the right side of FIG. 2 the mixing shaft 3 and the knives 4 that are connected therewith are hollow and have outlet holes 45 for letting through and guiding of gasses and/or liquids L. In FIG. 2A also a detail of the pivotable connection of the knives 4 with the mixing shaft 3 is shown. Here the scraper 13 at the lower end of the mixing shaft 3 is visible.

At the variant shown at the left side of FIG. 2 the angle B is variable which the knives 4 make with the vertical. Furthermore, the outer sidewall 6 of the mixing vessel 1 is bound with a ½ tube spiral 46 through which is passed a cooling and/or heating fluid. The lid 7 is provided with a tube stub 36 for the entrance of product Pi. At the lower end of the mixing vessel 1 a flat outlet slide 47 with an operating lever 48 for the outgoing product P0 is mounted.

At the upper side of the mixing vessel 1 the mixing shaft 3 is coupled by means of a transmission 49 to an inverted suspended drive motor 9, which transmission if fastened on the lid 7 by means of a heightened tube stub 8. In the axis 2 an inlet 50 for liquid Li is mounted. The lid 7 is also provided with a port 38 for a low pressure sprayer 39 for process liquid and/or gas.

The sidewall 6 of the mixing vessel 1 is provided at the right side with a port 34 for a thermometer 35.

A feature and advantage of the present invention as above described makes use of the unique mixing pattern which occurs in the mixing vessel when it is operated at high speed. The paddles accelerate the product in the direction of the vessel wall and cause the product to swirl. As a result of the conical shape of the vessel wall, the product moves upward by means of centrifugal force. Once the product reaches the upper part of the vessel, where no paddles are present, the product drops down again under the influence of gravity near the center and circulation is established. Finally, the centrifugal force causes a rubbing movement of the product along the inner wall, and the friction causes a very intensive mixing of the product.

Figure 4:
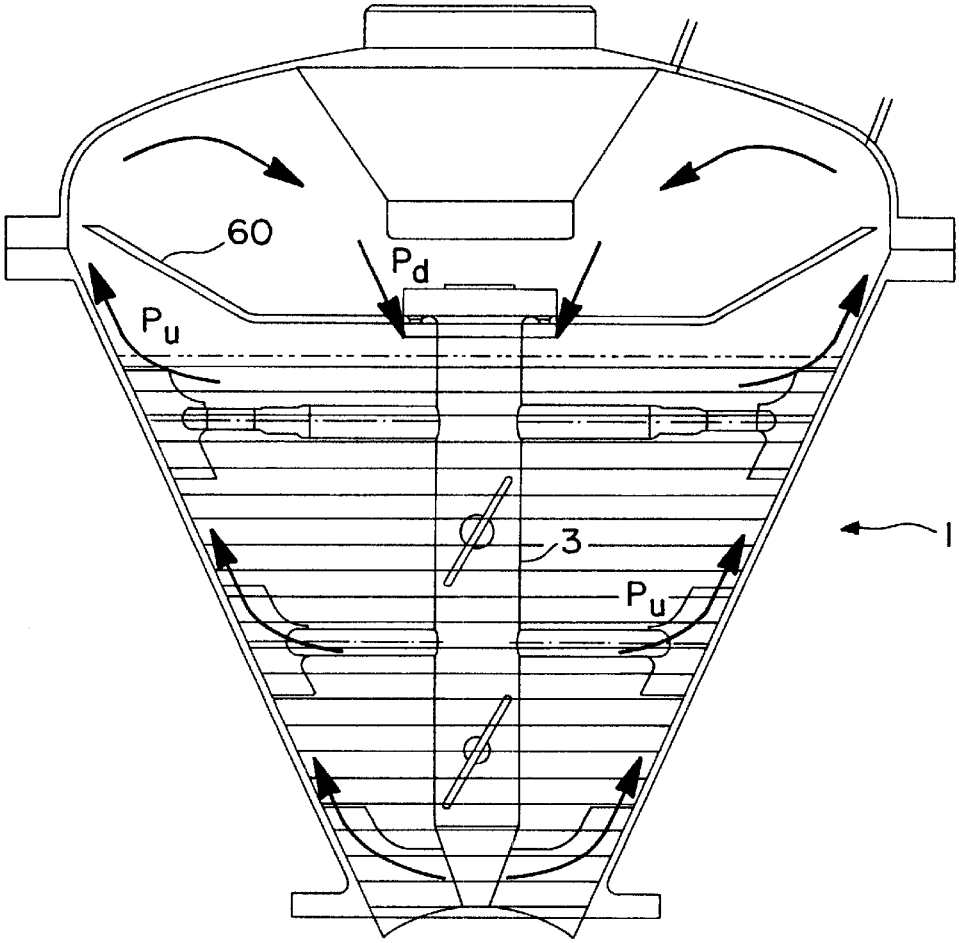
FIG. 4 is a cross-sectional view of a third embodiment of a mixing device according to the present invention.

The invention is susceptible to modification. While the product is forced upward by the high speed rotation of the paddles, due to the lack of paddles at the upper part of the vessel, the mixture slows its rise and then begins to fall inward and downward. However, by placing knives 60 coupled to the shaft 3 in the upper zone of the vessel, e.g. as shown in FIG. 4, having the same rotational speed (and thus a higher linear speed because of the greater diameter) as the paddles, the knives 60 have a reducing action on the product. At low speed of the paddles the product will not be forced upward and the knives 60 will have no function. Thus, the knives 60 do not have an effect on the product. However, at higher speed, the product is forced upward and the knives 60 break up lumps when mixing a liquid product, and grind coarse parts of a solid product.

Figure 5:
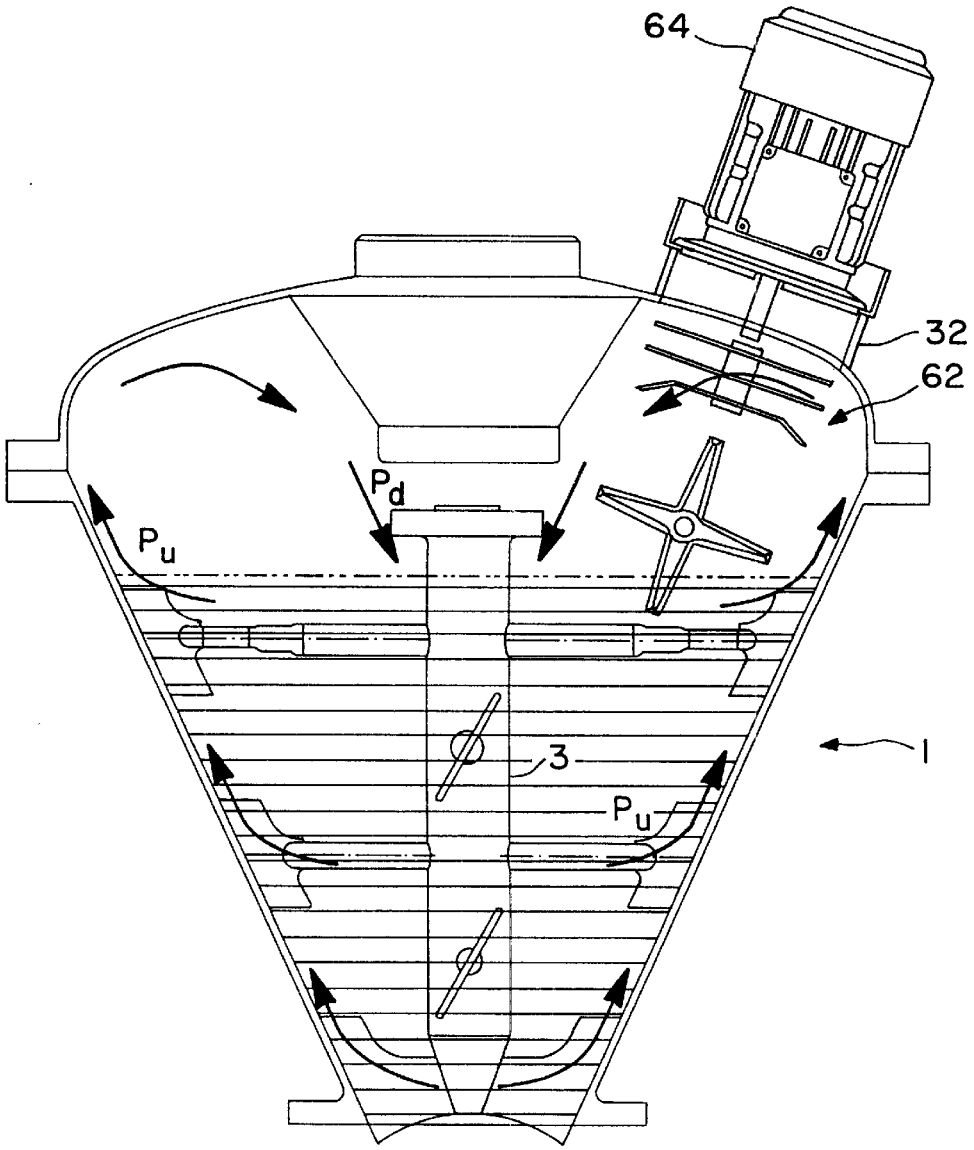
FIG. 5 is a cross-sectional view of a fourth embodiment of a mixing device according to the present invention.

Yet another embodiment of the invention shown in FIG. 5 employs a chopper 62 in the upper zone of the vessel. A chopper is a high speed knife head having a linear knife speed of 10–20 m/s. Chopper 62 is mounted through tube stub 32 and driven by a motor 64. Chopper 62 adds extra grinding force to the product. At low speed of the paddles, the product is not forced upward and the chopper 62 will have no function. The product will not be influenced by the immobile knives at lower speed. However, at a higher paddle speed, the product is moved up into contact with the chopper 62. As in the case of the knives 60, as described previously, chopper 62 eliminates lumps when mixing a liquid product and grinds coarse parts of a solid product.

What is claimed is:

1. A device for batch mixing, cooling, heating, drying and/or granulating powdery, granular and/or pasty materials, comprising:

a conical mixing vessel having a sidewall with a smooth inner wall surface and a vertical axis, said vessel narrowing in a downward direction;

a mixing shaft rotatably mounted for rotation in said vessel along said vertical axis;

a plurality of elements mounted to and projecting in a generally radial direction from said shaft to adjacent said vessel inner wall surface;

one or more mixing paddles pivotally mounted at a distal end of each projecting element to urge the material along the sidewall towards a top of the vessel by centrifugal force when said paddles are rotated by said shaft;

a chopper in the top of the vessel for chopping material in an upper portion of the vessel, above said mixing paddles; and a drive motor for rotatably driving said mixing shaft.

2. A device according to claim 1, wherein the drive motor is adapted to rotatably drive the mixing shaft to rotate at 100 to 1000 revolutions per minute.

3. A device according to claim 1, and further including a scraper blade mounted adjacent a lower end of the mixing shaft for obviating dead space in the bottom of the mixing vessel.

4. A device according to claim 1, and further including a removable lid mounted to the upper end of said conical mixing vessel, an inner side of said lid having a substantially ellipsoid shape whereupon, during operation, product contained in said mixing vessel moves upward along the inner wall surface of the vessel and onto an inner surface of the lid in a direction towards the center of the lid, prior to dropping back down into the mixing vessel.

5. A device according to claim 4, where said chopper comprises chopping knives mounted on a separate rotatable shaft extending through said lid.

6. A device according to claim 1, wherein said drive motor is mounted to the top of a central tube stub carried on said lid, and said mixing shaft is directly coupled to a drive shaft of said drive motor.

7. A device according to claim 6, wherein said lid is airtight sealable to said mixing vessel.

8. A device according to claim 6, wherein said lid is fastened to said mixing vessel by means of fasteners.

9. A device according to claim 6, wherein said lid includes a port for a high pressure cleaning sprayer.

10. A device according to claim 6, wherein said drive motor is mounted to the lid on a raised tube stub which is offset from the vertical axis of the mixing vessel, said mixing shaft being coupled to the drive motor through a transmission.

11. A device according to claim 6, wherein the lid further includes a port having a sprayer mounted therein for introduction of a process liquid or gas.

12. A device according to claim 6, wherein the lid further includes a tube stub having a looking glass mounted therein.

13. A device according to claim 6, and further including thermometer mounted through a port in the sidewall of the mixing vessel.

14. A device according to claim 6, wherein the lid includes a tube stub for introduction of product.

15. A device according to claim 6, wherein the lid includes a tube stub having a lamp mounted therein.

16. A device according to claim 6, and further including a hoist for lifting said lid away from said vessel.

17. A device according to claim 1, wherein the sidewall of said mixing vessel is of double wall construction having one or more fluid passageways therein for passage of a cooling or heating fluid.

18. A device according to claim 1, and further comprising an outer jacket on said mixing vessel for heating and/or cooling of the contents of said vessel.

19. A device according to claim 1, when said mixture vessel is open at its lower end, and further including a ball segment valve or a slide valve mounted at a lower end of the mixing vessel for closing the vessel.

20. A device according to claim 1, wherein said chopper comprises chopping knives mounted for rotation with said shaft above said mixing paddles.

21. A device for mixing, cooling, heating, drying and/or granulating powdery, granular and/or pasty materials, comprising:

a conical mixing vessel having a sidewall with a smooth inner wall surface and a vertical axis, said vessel narrowing in a downward direction;

a mixing shaft rotatably mounted for rotation in said vessel along said vertical axis;

a plurality of elements mounted to and projecting in a generally radial direction from said shaft to adjacent said vessel inner wall surface;

one or more mixing paddles pivotally mounted at a distal end of each projecting element, each paddle coupled to a single element;

a chopper in the top of said vessel for chopping material in an upper portion of the vessel above said mixing paddles; and a drive motor for rotatably driving said mixing shaft.

22. A device according to claim 21, wherein said chopper comprises chopping knives mounted for rotation with said shaft above said mixing paddles.

23. A device according to claim 21, wherein said mixing vessel further comprises a lid, and said chopper comprises chopping knives mounted on a separate rotatable shaft extending through said lid.

24. A device for mixing, cooling, heating, drying and/or granulating powdery, granular and/or pasty materials, comprising:

a conical mixing vessel having a sidewall with a smooth, inner wall surface and a vertical axis, said vessel narrowing continuously from a top of the vessel to a base of the vessel in a downward direction;

a mixing shaft rotatably mounted for rotation in said vessel along said vertical axis;

a plurality of elements mounted to and projecting in a generally radial direction from said shaft adjacent said vessel inner wall surface;

one or more mixing paddles pivotally mounted at a distal end of each projecting element;

a chopper in the top of said vessel for chopping material in an upper portion of the vessel, above said mixing paddles; and a drive motor for rotatably driving said mixing shaft.

25. A device according to claim 24, wherein said chopper comprises chopping knives mounted for rotation with said shaft above said mixing paddles.

26. A device according to claim 24, wherein said mixing vessel further comprises a lid, and said chopper comprises chopping knives mounted on a separate rotatable shaft extending through said lid.

27. A device for batch mixing, cooling, heating, drying and/or granulating powdery, granular and/or pasty materials, comprising:

a conical mixing vessel having a sidewall with a smooth inner wall surface and a vertical axis, said vessel narrowing in a downward direction;

a mixing shaft rotatably mounted for rotation in said vessel along said vertical axis;

a plurality of elements mounted to and projecting in a generally radial direction from said shaft to adjacent said vessel inner wall surface;

one or more mixing paddles pivotally mounted at a distal end of each projecting element to urge the material along the sidewall towards a top of the vessel by centrifugal force;

a drive motor for rotatably driving said mixing shaft and paddles at 100 to 1000 revolutions per minute whereby to cause materials contained in said vessel to swirl and move toward and up the wall of the vessel due to centrifugal force; and a chopper comprising chopping knives mounted for rotation with said shaft above said mixing paddles.

28. A device according to claim 27, and further including a scraper blade mounted adjacent a lower end of the mixing shaft for obviating dead space in the bottom of the mixing vessel.

29. A device according to claim 27, and further including a removable lid mounted to the upper end of said conical mixing vessel, an inner side of said lid having a substantially ellipsoid shape whereupon, during operation, product contained in said mixing vessel moves upward along the inner wall surface of the vessel and onto an inner surface of the lid in a direction towards the center of the lid, prior to dropping back down into the mixing vessel.

30. A device according to claim 27, wherein said drive motor is mounted to the top of a central tube stub carried on said lid, and said mixing shaft is directly coupled to a drive shaft of said drive motor.

31. A device according to claim 30, wherein said lid is airtight sealable to said mixing vessel.

32. A device according to claim 30, wherein said lid is fastened to said mixing vessel by means of fasteners.

33. A device according to claim 30, wherein said lid includes a port for a high pressure cleaning sprayer.

34. A device according to claim 30, wherein said drive motor is mounted to the lid on a raised tube stub which is offset from the vertical axis of the mixing vessel, said mixing shaft being coupled to the drive motor through a transmission.

35. A device according to claim 30, wherein the lid further includes a port having a sprayer mounted therein for introduction of a process liquid or gas.

36. A device according to claim 30, wherein the lid further includes a tube stub having a looking glass mounted therein.

37. A device according to claim 30, and further including thermometer mounted through a port in the sidewall of the mixing vessel.

38. A device according to claim 30, wherein the lid includes a tube stub for introduction of product.

39. A device according to claim 30, wherein the lid includes a tube stub having a lamp mounted therein.

40. A device according to claim 30, and further including a hoist for lifting said lid away from said vessel.

41. A device according to claim 27, wherein the sidewall of said mixing vessel is of double wall construction having one or more fluid passageways therein for passage of a cooling or heating fluid.

42. A device according to claim 27, and further comprising on an outer jacket on said mixing vessel for heating and/or cooling of the contents of said vessel.

43. A device according to claim 27, when said mixture vessel is open at its lower end, and further including a ball segment valve or a slide valve mounted at a lower end of the mixing vessel for closing the vessel.

44. A device for mixing, cooling, heating, drying and/or granulating powder, granular and/or pasty materials, comprising:

a conical mixing vessel having a sidewall with a smooth inner wall surface and a vertical axis, said vessel narrowing in a downward direction;

a mixing shaft rotatably mounted for rotation in said vessel along said vertical axis;

a plurality of elements projecting in a generally radial direction from said shaft to adjacent said vessel inner wall surface;

one or more mixing paddles pivotally mounted at a distal end of each projecting element, each paddle coupled to a single element;

a drive motor for rotatably driving said mixing shaft and paddles at a speed sufficient to cause materials contained in said vessel to swirl and move toward and up the wall of the vessel due to centrifugal force; and a chopper comprising chopping knives mounted for rotation with said shaft above said mixing paddles.

45. A device according to claim 44, wherein said mixing vessel further comprises a lid, and a chopper comprising chopping knives mounted on a separate rotatable shaft extending through said lid.

46. A device for mixing, cooling, heating, drying and/or granulating powdery, granular and/or pasty materials, comprising:

a conical mixing vessel having a sidewall with a smooth, inner wall surface and a vertical axis, said vessel narrowing continuously from a top of the vessel to a base of the vessel in a downward direction;

a mixing shaft rotatably mounted for rotation in said vessel along said vertical axis;

a plurality of elements mounted to and projecting in a generally radial direction from said shaft adjacent said vessel inner wall surface;

one or more mixing paddles pivotally mounted at a distal end of each projecting element;

a drive motor for rotatably driving said mixing shaft and paddles at a speed sufficient to cause materials contained in said vessel to swirl and move toward and up the wall of the vessel due to centrifugal force; and a chopper comprising chopping knives mounted for rotation with said shaft above said mixing paddles.

47. A device according to claim 46, wherein said mixing vessel further comprises a lid, and a chopper comprising chopping knives mounted on a separate rotatable shaft extending through said lid.

* * * * *